United States Patent [19]

Gullion

[11] Patent Number: 4,742,874

[45] Date of Patent: May 10, 1988

[54] SUBSEA WELLHEAD SEAL ASSEMBLY

[75] Inventor: Steven D. Gullion, Houston, Tex.

[73] Assignee: Cameron Iron Works USA, Inc., Houston, Tex.

[21] Appl. No.: 44,582

[22] Filed: Apr. 30, 1987

[51] Int. Cl.[4] ..... E21B 33/035

[52] U.S. Cl. ..... 166/348; 166/115; 166/182; 166/208; 166/217; 166/368; 277/118; 277/236; 285/141; 285/315; 285/351; 285/382.5

[58] Field of Search ..... 166/348, 182, 85, 88, 166/115, 195, 179, 217, 206-208, 368; 285/351, 352, 139-143, 315, 339, 382, 382.1, 382.2, 382.4, 382.5; 277/236, 116.2, 116.4, 116.6, 116.8, 117, 118, 115, 214, 190

[56] References Cited

U.S. PATENT DOCUMENTS

| | | | |
|---|---|---|---|
| 3,282,346 | 11/1966 | Claycomb | 166/182 |
| 4,131,287 | 12/1978 | Gunderson et al. | 277/236 X |
| 4,595,053 | 6/1986 | Watkins et al. | 166/209 |
| 4,600,055 | 7/1986 | Durst et al. | 166/134 X |
| 4,641,708 | 2/1987 | Wightman | 166/208 |
| 4,646,845 | 3/1987 | Boeker | 166/387 |
| 4,650,225 | 3/1987 | Lee et al. | 285/351 X |

*Primary Examiner*—James A. Leppink
*Assistant Examiner*—Hoang C. Dang
*Attorney, Agent, or Firm*—Vinson & Elkins

[57] ABSTRACT

An improved annular seal between tubular members in a subsea wellhead having an annular seal member with a U shape in section with the opening facing upwardly and two interengaged annular wedges for energizing the sealing surfaces of the inner and outer portions of the seal member at different levels. The interengagement of the wedges includes sufficient play to provide proper energizing of both inner and outer sealing surfaces at the same time. Further, the inner sealing surface is positioned at a much higher level than the outer sealing surface and close to the upper end of the inner member in which it is to seal to minimize the setting force for the inner sleeve and to minimize the amount of drag the seal will incur when retrieved. Also, the location of the outer sealing surface close to the inner member shoulder minimizes the reaction path of the lockdown sleeve. A ring engages with the upper interior of the outer leg of the seal and has a lower surface which is tapered downwardly and inwardly and is engaged by a mating taper on the upper surface of the outer wedge member to ensure release of the seal from set position.

4 Claims, 3 Drawing Sheets

SUBSEA WELLHEAD SEAL ASSEMBLY

BACKGROUND

In subsea well operations, seals are often required in the annular space between tubular members, such as between a hanger and the wellhead housing surrounding the hanger from which the hanger is supported. Sometimes difficulty is encountered in that the members are not exactly concentric and this creates a differential in the radial space in which the seal is to be positioned. Obtaining a metal-to-metal type sealing engagement with such an eccentric annular space is very difficult and fraught with errors and troubles.

Seals which have been used have included the seal disclosed in U.S. Pat. No. 3,649,032 which includes a resilient member having a malleable metallic ring including axial undulations providing inner and outer annular crests which seal against the inner and outer sealing surfaces.

U.S. Pat. No. 4,641,708 discloses a subsea casing hanger having an annular seal that includes a main body with an inner upstanding rim and an outer upstanding rim having grooves on the inner surface of the inner rim and on the outer surface of the outer rim and a flexibility groove in the base immediately below the junction of the rims to the base and an annular wedging ring adapted to move between the two members to bring them into sealing engagement with the interior surface of the well housing and the exterior surface of the hanger. It is noted that a groove surface is provided in the housing and hanger surfaces, but it is positioned above the sealing portion on the inner and outer rims.

U.S. Pat. No. 3,913,670 discloses an annular seal to seal between elements in a subsurface wellhead which includes a resilient annular packing which is compressed axially to expand it radially inward and outward into sealing engagement with the inner and outer surfaces defining the annulus.

U.S. Pat. No. 4,550,782 discloses an annular seal for a wellhead which includes an annular ductile metal ring with inner and outer grooves connected by bores and an elastomeric material embedded in and extending from said grooves and bores. The exterior surface of the ring is cylindrical and the interior surface is tapered upwardly and inwardly.

U.S. Pat. No. 4,595,053 discloses an annular seal for use in sealing between subsea wellhead equipment which includes wickers or small parallel and circular grooves formed perpendicular to the axis of the bore. The seal is an annular ring which is cup-shaped in section and includes a wedge ring which is forced into the seal opening to wedge the sides of the seal ring into sealing engagement with the wickers.

U.S. Pat. No. 4,595,063 discloses another wellhead structure in which a pair of resilient seal rings are positioned on opposite sides of a metal ring and are actuated by axial compression with a ring having legs extending into individual engagement with each of the resilient seal rings.

While each of these devices of the prior art provide sealing between wellhead members none of them is capable of having metal-to-metal sealing engagement between such members when the members are not concentric.

SUMMARY

The present invention relates to an improved annular seal for sealing between tubular members in a subsea wellhead and having an annular seal member with a U-shaped section and with the opening of the U facing upwardly and having two interengaged annular wedges for energizing the sealing surfaces of the inner and outer portions of the seal member at different levels. The interengagement of the wedges includes sufficient radial play to provide proper energizing of both inner and outer sealing surfaces at the same time. Further the inner sealing surface is positioned at a much higher lever than the outer sealing surface and close to the upper end of the inner member against which it is to seal so that the the drag on the inner member on retrieval is minimized and the setting force needed is also minimized.

An object of the present invention is to provide an improved annular seal for sealing across the annulus between two wellhead members which, when energized, will provide positive seals against the exterior of the inner wellhead member and against the interior of the outer wellhead member.

Another object is to provide an improved annular metal-to-metal seal for subsea wellhead members which ensures positive sealing even through the two wellhead members are not exactly concentric.

A further object is to provide an improved annular seal for subsea wellhead members which ensures positive sealing even if the eccentricity of the two wellhead members changes.

Still another object is to provide an improved annular seal for subsea wellhead members which is readily released from sealing position.

A still further object is to provide an improved annular seal for subsea wellhead members which prevents setting of the seal during running.

BRIEF DESCRIPTION OF THE DRAWINGS

These and other objects and advantages are hereinafter set forth and explained with reference to the drawings wherein.

DESCRIPTION OF THE PREFERRED EMBODIMENT

Figure 1:
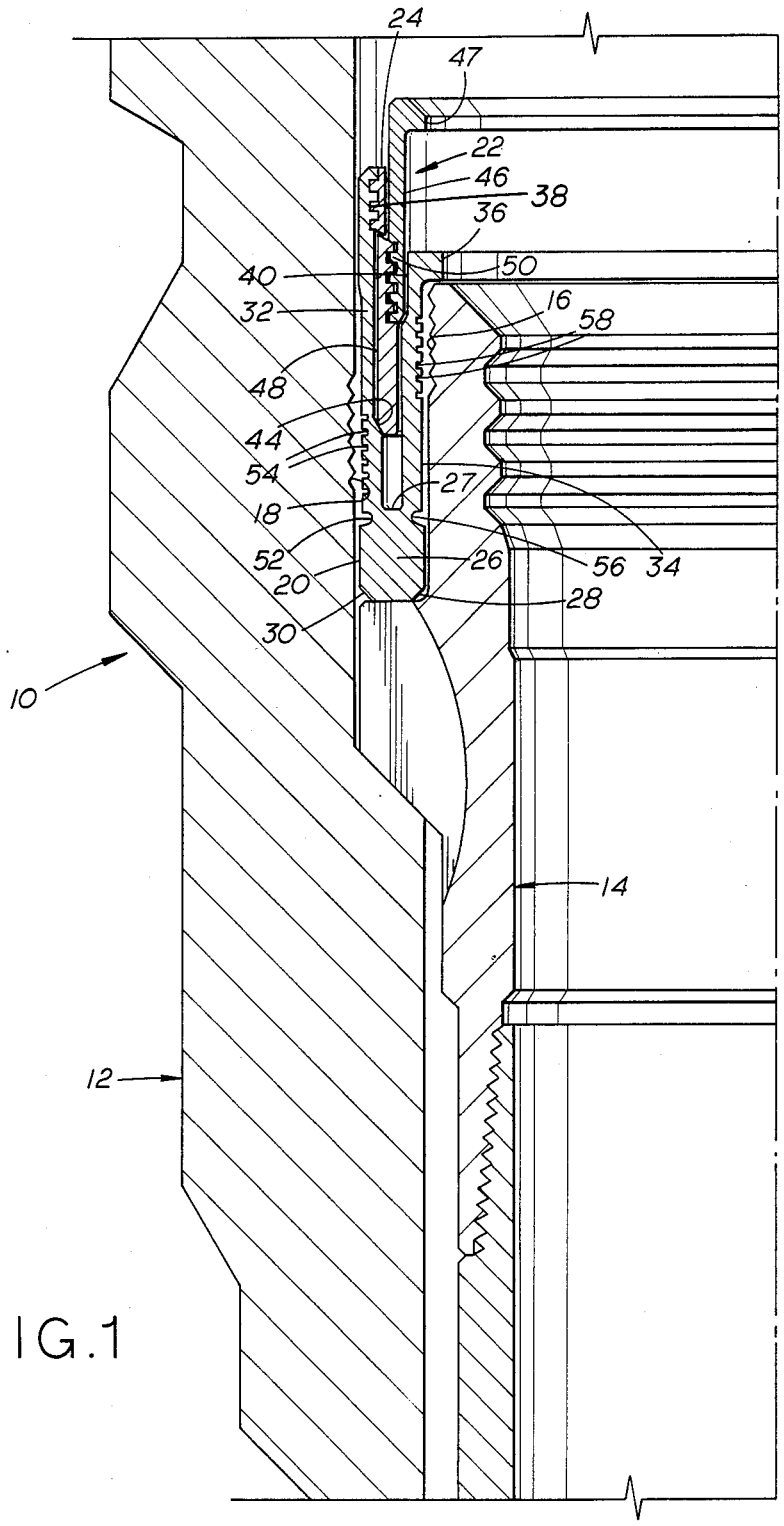
FIG. 1 is a partial sectional view of the improved sealing assembly of the present invention in the unset position.

Improved sealing assembly 10 of the present invention is shown in FIG. 1 in position within the annulus between the interior of wellhead housing 12 and the exterior of hanger 14. The upper exterior of hanger 14 is provided with sealing surface 16 which includes small serrations or grooves 15 against which sealing assembly 10 is to seal and the interior of wellhead housing 12 includes sealing surface 18 which includes small serrations or grooves 17 and which is similarly prepared and against which sealing assembly 10 is to seal. As shown, sealing surface 16 is at a higher level than sealing surface 18 to minimize the amount of setting force and to minimize the amount of drag the seal will incur when retrieved. Also, this structure locates the outer sealing surface close to the inner member shoulder to thereby minimize the reaction path of the lockdown sleeve.

Figure 2:
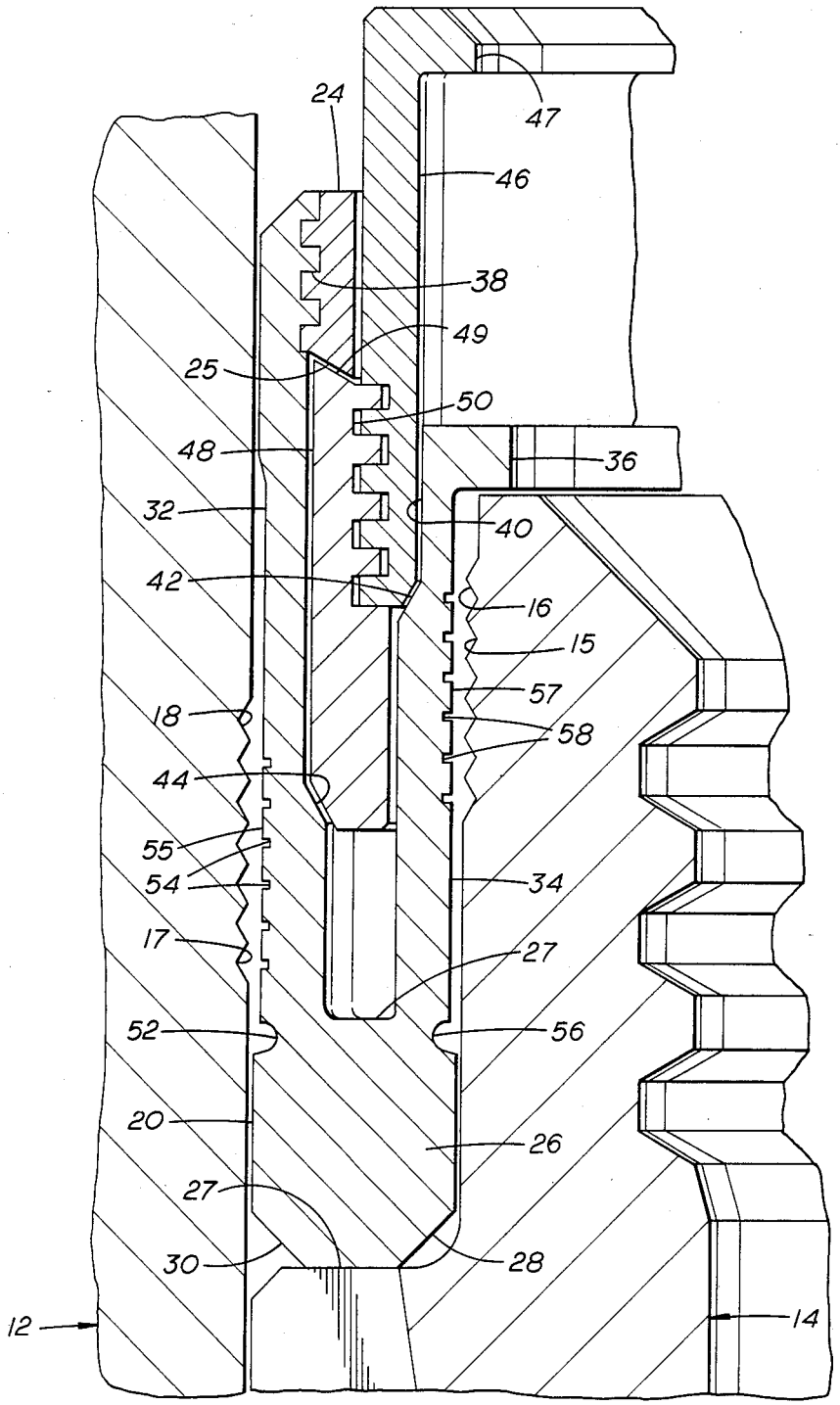
FIG. 2 is a detail partial sectional view of the sealing assembly shown in FIG. 1 in unset position.

As shown in FIG. 2, sealing assembly 10 includes annular U-shaped metal seal 20, wedging assembly 22 and closure ring 24 which is positioned to allow retrieval of sealing assembly 10 from its set position. Lower surface 25 of closure ring 24 is tapered downwardly and inwardly. Annular seal 20 includes base ring 26 having inwardly facing taper 28 and outwardly facing taper 30 on its lower surface to allow smooth running of sealing assembly 10, outer leg 32 extending upward from the outer portion of base ring 26 and inner leg 34 extending upward from the inner portion of base ring 26. As shown legs 32 and 34 are spaced apart to receive wedging assembly 22. The upper end of inner leg 34 has flange 36 extending inwardly therefrom and the upper interior of outer leg 32 has threads 38 to receive closure ring 24. The outer surface 40 of inner leg 34 is generally cylindrical for a short distance and then tapers downwardly and outwardly as tapered surface 42 and is generally cylindrical below tapered surface 42 to the top of base ring 26. The inner surface of outer leg 32 below threads 38 is generally cylindrical for a distance and then tapers downwardly and inwardly as tapered surface 44 and is generally cylindrical below tapered surface 44 to the top of base ring 26.

Wedging assembly 22 includes inner wedging ring 46 and outer wedging ring 48. Rings 46 and 48 are interengaged by their respective threads 50 which preferably are loose fitting Acme type threads as hereinafter explained. The upper end of outer wedging ring 48 has surface 49 which tapers upwardly and outwardly and which mates with tapered surface 25 on the under side of closure ring 24. The upper end of inner wedge ring 46 includes flange 47 directed inwardly for engagement by a suitable tool for retrieval of seal assembly 10 from the annulus between hanger 14 and well housing 12. The lower inner portion of inner wedging ring 46 is tapered at the same angle as tapered surface 42 and the lower outer surface of outer wedging ring 48 is tapered at the same angle as tapered surface 44.

Groove 52 in the exterior surface of annular seal 20 is slightly below the junction of outer leg 32 and base ring 26 and provides flexibility to outer leg 32 during the setting of seal assembly 10. Additionally, grooves 54 in the exterior surface of outer leg 32 are provided to provide additional flexibility to outer leg 32 and further to provide room for a pressure compensation material 55 to relieve pressure resulting from liquids trapped between outer leg 32 and serrations 17 on sealing surface 18 during setting. A typical pressure compensating material is microspheres potted in or encapsulated by an epoxy resin such as the material manufactured by Emersson & Cuming Division of W. R. Grace & Co. Groove 56 in the interior surface of annular seal 20 is slightly below the junction of inner leg 34 and base ring 26 and provides flexibility to inner leg 34 during the setting of seal assembly 10. Grooves 58 in the interior surface of inner leg 34 also function to provide improved flexibility to inner leg 34 and to provide room for pressure compensation material 57 to relieve pressure resulting from liquids trapped between inner leg 34 and serrations 15 on sealing surface 16 during setting.

Figure 3:
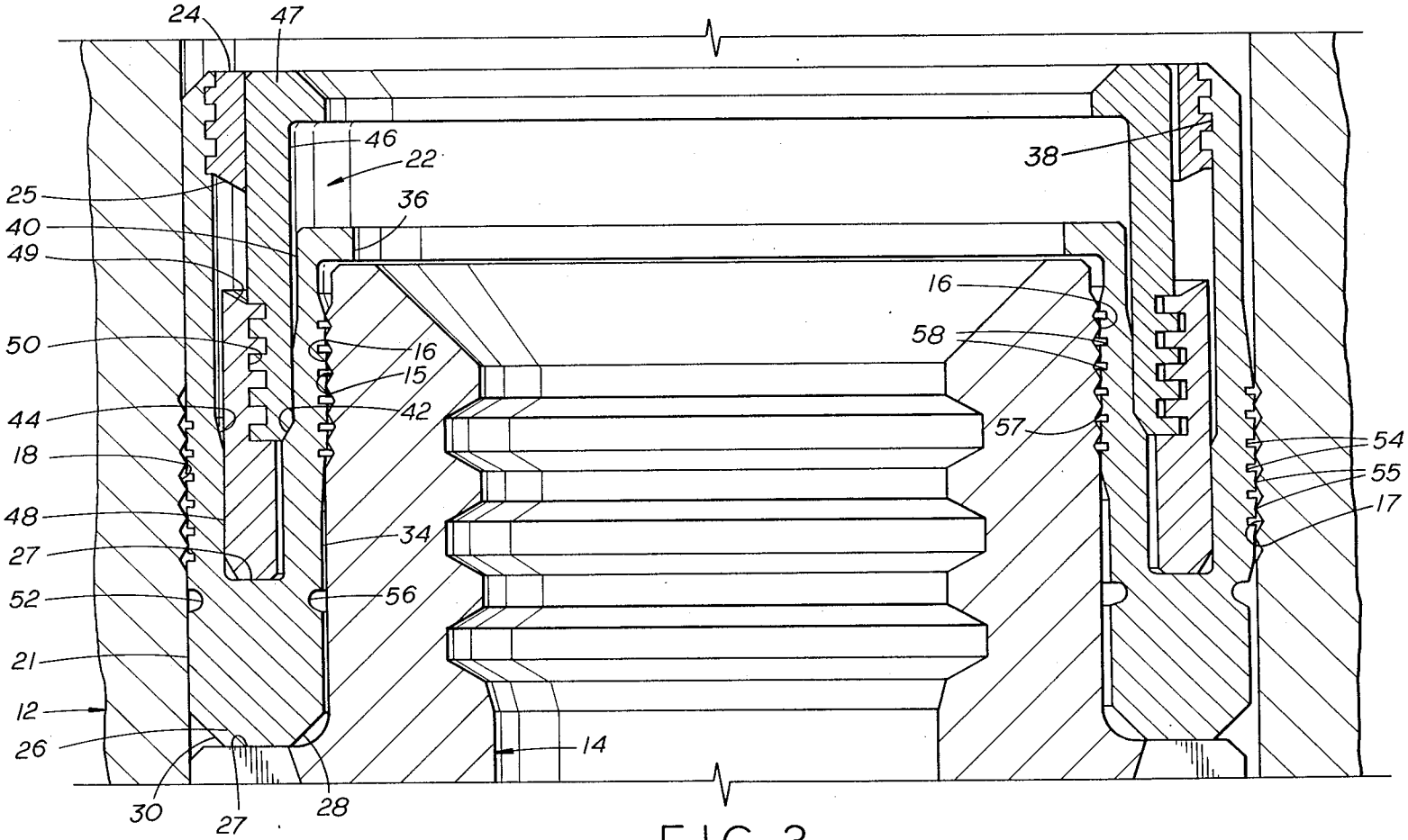
FIG. 3 is a full sectional view of the sealing assembly shown in FIGS. 1 and 2 but shown in the set position with the inner member not concentric with the wellhead bore.

The sealing assembly 10 is shown in its set position in FIG. 3. It should be noted that FIG. 3 also represents one of the advantages of the present invention in that the hanger 14 is not centered within housing 12. To set seal assembly 10, wedging assembly 22 is forced downward within the space between legs 32 and 34 of annular seal 20. Wedging assembly 22 is moved downwardly therein until outer wedging ring 48 engages upper surface 27 of base ring 26 of annular seal 20. In this position, outer wedging ring 48 has engaged tapered surface 44 on the interior of outer leg 32 and the inner surface therebelow and deformed outer leg 32 into sealing engagement with sealing surface 18. Also, inner wedging ring 46 has engaged tapered surface 42 on the interior of inner leg 34 and the outer surface therebelow and deformed inner leg 34 into sealing engagement with sealing surface 16 on the exterior of hanger 14.

A careful comparison of the two sides of the components of the illustrated wellhead structure shown in FIG. 3 discloses the displacement of hanger 14 to the left so that it is against the interior of housing 12 on the left side and is spaced therefrom a substantial distance on the right side. Because of the loose threaded engagement between wedging rings 46 and 48, each of the wedging ring is capable of wedging its leg independently of the radial displacement of the hanger 14 in housing 12. The movement of the wedging assembly 22 requires much less deformation of the outer leg 32 on the side against which hanger 14 engages the interior of housing 12 (the left side of the drawing) than on the other side so that the outer ring 48 it urged against the opposite side of the outer leg 32 and causes sufficient movement to ensure sealing engagement of outer leg 32 with sealing surface 18 completely around the interior of housing 12. Similarly, inner wedging ring 46 can move downwardly around inner leg 34 and is not offset by the action of outer wedging ring 48. Thus, the offset of the hanger in the housing does not interfere with the effectiveness of the sealing of the improved seal of the present invention.

What is claimed is:

1. An annular subsea wellhead seal assembly, comprising an annular metal seal ring having a U-shape in section with spaced legs and an opening between the legs, and an energizing ring assembly positioned in the opening of said seal ring including an outer energizing ring having internal lands and grooves, an inner energizing ring having external lands and grooves mating with the internal lands and grooves of said outer energizing ring, said inner and outer energizing rings being sized to provide a preselected amount of radial clearance therebetween while maintaining the interdigitation of their lands and grooves.

2. A seal assembly according to claim 1 wherein said seal ring includes a base, an outer leg extending upward from said base and having an outer sealing area, and an inner leg extending upward from said base and spaced inwardly from said outer leg and having an inner sealing area, the interior of said outer leg being generally cylindrical for a substantial portion of its upper length and then tapering inwardly and downwardly to a second cylindrical surface extending upward from said base with the sealing area of said outer leg being immediately below said tapered portion of its interior, the exterior of said inner leg generally cylindrical for a short portion of its upper length and then tapering downwardly and outwardly to a second cylindrical surface extending upward from said base and spaced from and generally parallel to the second cylindrical of said outer leg with the sealing area of said inner leg being immediately below said tapered portion of its exterior and substantially above the sealing area of said outer leg.

3. A sealing assembly according to claim 2 wherein said outer leg includes external annular grooves in its sealing area, and said inner leg includes internal annular grooves in its sealing area.

4. A subsea wellhead comprising a wellhead housing, a hanger positioned within said housing and having its exterior surface spaced from the interior of the housing, a sealing assembly positioned between said wellhead housing and said hanger for sealing in the annular space therebetween, sealing grooves on the interior of said housing, sealing grooves on the exterior of said hanger and positioned at a level above the housing sealing grooves whereby the sealing assembly seals against the hanger at a level above the level at which it seal against the housing, and wherein said sealing assembly includes an annular metal seal ring being U-shaped in section with spaced legs and an opening between the legs, and an energizing ring assembly positioned in the opening of said seal ring including an outer energizing ring having internal lands and grooves, an inner energizing ring having external lands and grooves mating with the internal lands and grooves of said outer energizing ring, said inner and outer energizing rings being sized to provide a preselected amount of radial clearance while maintaining the engagement of their lands and grooves.

* * * * *